US011649687B1

(12) United States Patent
Dawson

(10) Patent No.: US 11,649,687 B1
(45) Date of Patent: May 16, 2023

(54) HIGH EXPANSION ANTI-ROTATION ANCHOR CATCHER

(71) Applicant: James Dawson, Nanaimo (CA)

(72) Inventor: James Dawson, Nanaimo (CA)

( * ) Notice: Subject to any disclaimer, the term of this patent is extended or adjusted under 35 U.S.C. 154(b) by 0 days.

(21) Appl. No.: 17/707,042

(22) Filed: Mar. 29, 2022

(51) Int. Cl.
*E21B 23/01* (2006.01)
*E21B 17/10* (2006.01)

(52) U.S. Cl.
CPC ..... *E21B 23/01* (2013.01); *E21B 17/1021* (2013.01); *E21B 17/1078* (2013.01)

(58) Field of Classification Search
CPC ..... E21B 23/00; E21B 23/01; E21B 17/1021; E21B 17/1078; E21B 33/129
See application file for complete search history.

(56) References Cited

U.S. PATENT DOCUMENTS

| | | | | |
|---|---|---|---|---|
| 1,866,087 | A | 7/1932 | Cromwell | |
| 2,546,950 | A | 3/1951 | Nixon | |
| 3,058,526 | A | 10/1962 | Douglass | |
| 3,556,216 | A * | 1/1971 | Condra | E21B 23/01 166/217 |
| 6,062,309 | A | 5/2000 | Gosse | |
| 6,629,568 | B2 | 10/2003 | Post | |
| 6,796,380 | B2 | 9/2004 | Xu | |
| 6,942,666 | B2 | 9/2005 | Overaker | |
| 7,377,328 | B2 | 5/2008 | Dewey | |
| 8,075,234 | B2 | 12/2011 | McClure | |
| 9,447,648 | B2 | 9/2016 | Mitchell | |
| 9,482,067 | B2 * | 11/2016 | Dewars | E21B 23/0411 |
| 9,850,726 | B2 | 12/2017 | Gandikota | |
| 10,415,336 | B2 | 9/2019 | Benzie | |
| 11,136,880 | B1 * | 10/2021 | McCormick | E21B 47/01 |
| 11,203,908 | B2 * | 12/2021 | Al Hussin | E21B 23/01 |
| 11,442,913 | B2 * | 9/2022 | Hasberg | G06N 20/00 |
| 2004/0031606 | A1 * | 2/2004 | Xu | E21B 23/01 166/213 |
| 2009/0126926 | A1 | 5/2009 | Moore | |
| 2013/0113227 | A1 * | 5/2013 | Mitchell | E21B 4/18 294/86.24 |
| 2015/0233199 | A1 | 8/2015 | Moore et al. | |
| 2015/0322740 | A1 | 11/2015 | Marshala | |

* cited by examiner

*Primary Examiner* — Yong-Suk (Philip) Ro
(74) *Attorney, Agent, or Firm* — Michael D. Eisenberg

(57) ABSTRACT

A high expansion anti-rotation anchor catcher includes a helical track positioned on an exterior surface of a tubular body. An expandable gripper cage is provided having an axially fixed hub mounted for rotation about the tubular body and an axially movable hub mounted for rotation about the tubular body. Pivoting linkages which support outwardly oriented grippers extend between the axially fixed hub and the axially movable hub. The axially movable hub has a track follower that engages the helical track on the exterior surface of the tubular body. Rotation of the tubular body in a first rotational direction causes the track follower to move along the helical track toward the axially fixed hub, thereby placing the expandable gripper cage in compression and causing the pivoting linkages and grippers to pivot outwardly away from the tubular body to secure the anchor in position.

5 Claims, 6 Drawing Sheets

SECTION A-A

HIGH EXPANSION ANTI-ROTATION ANCHOR CATCHER

FIELD

There is described a high expansion anchor, which was developed for use with a progressive cavity pump (PC Pump) for preventing rotation of the PC Pump and associated tubing string and vertically arrest ("catch") the PC Pump from falling down the well, but potentially has other applications.

BACKGROUND

An anti-rotation anchor is used with a PC pump to stop rotation of the tubing string caused by pump rotation. Rotation of the tubing string can cause a backing off of threaded connections and the loss of the PC pump down the well.

U.S. Patent Publication 215/0233199 (Moore et al) titled "Quarter Turn Tubing Anchor Catcher" describes a tubing anchor which is set by rotation in a first direction and released by rotation in a second direction.

U.S. Pat. No. 6,796,380 (Xu) titled "High Expansion Anchor System" describes an anchor system that uses linkages to increase the expansion limit of the anchor system.

SUMMARY

There is provided a high expansion anti-rotation anchor catcher which includes a tubular body having an axis, a first end, a second end, and an exterior surface. At least one coupling is positioned at the first end of the tubular body or the second end of the tubular body. A helical track is positioned on the exterior surface of the tubular body. An expandable gripper cage is provided having an axially fixed hub mounted for rotation about the tubular body and an axially movable hub mounted for rotation about the tubular body. Pivoting linkages which support outwardly oriented grippers extend between the axially fixed hub and the axially movable hub. The axially movable hub has a track follower that engages the helical track on the exterior surface of the tubular body. Rotation of the tubular body in a first rotational direction causes the track follower to move along the helical track toward the axially fixed hub, thereby placing the expandable gripper cage in compression and causing the pivoting linkages and grippers to pivot outwardly away from the tubular body. Rotation of the tubular body in a second rotational direction causes the track follower to move along the helical track away from the axially fixed hub, thereby placing the expandable gripper cage in tension and causing the pivoting linkages and grippers to pivot inwardly toward the tubular body.

The high expansion anti-rotation anchor catcher, as described above, is easily set in position downhole by rotation of the tubing string. Should the operation of the PC pump impart a further rotational force, any rotation of the tubular body merely serves to further expand the expandable gripper cage. The range of expansion of the high expansion anti-rotation anchor catcher allows the high expansion anti-rotation anchor catcher to be used with different sizes of pipe. It also allows for a measure of safety, as a high expansion anti-rotation anchor catcher that is functioning at its outer expansion limit could become dislodged if a great enough force is applied. The tool serves as both an anti-rotation role to anchor against rotation and a catcher role to vertically arrest ("catch") the PC pump and prevent it from falling down the well.

To assist in running the high expansion anti-rotation anchor catcher into and out of the well, it is preferred that centralizers be provided. To fulfil this function, an expandable centralizer cage is provided having an axially slidable hub that slides axially along the exterior of the tubular body toward a second hub. Pivoting linkages which support centralizer blocks extend between the axially slidable hub and the second hub. A spring is provided which acts against a shoulder on the exterior surface of the tubular housing to exert a force upon the axially slidable hub urging the axially slidable hub along the exterior of the tubular body toward the second hub. This places the expandable centralizer cage in compression and causes the pivoting linkages and centralizer blocks to pivot outwardly away from the tubular body.

In operation, the spring compresses the expandable centralizer cage which causes the centralizer blocks to engage the inside of the pipe as the high expansion anti-rotation anchor catcher is inserted into or drawn out of the well.

In order to keep the tubular body of the high expansion anti-rotation anchor catcher as short as possible, it is preferred that the axially movable hub of the expandable gripper cage serve as the second hub for the expandable centralizer cage. This also plays a role in deployment of expandable gripper cage, as it maintains the expandable gripper cage in a stationary position while the tubular body rotates.

When the high expansion anti-rotation anchor catcher is to be positioned below the PC Pump, it is possible to provide the high expansion anti-rotation anchor catcher with a single coupling. However, if the high expansion anti-rotation anchor catcher is to be positioned above the PC Pump, two couplings are required. To provide maximum flexibility, it is preferred that a first coupling be positioned at the first end of the tubular body and a second coupling be positioned at the second end of the tubular body.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
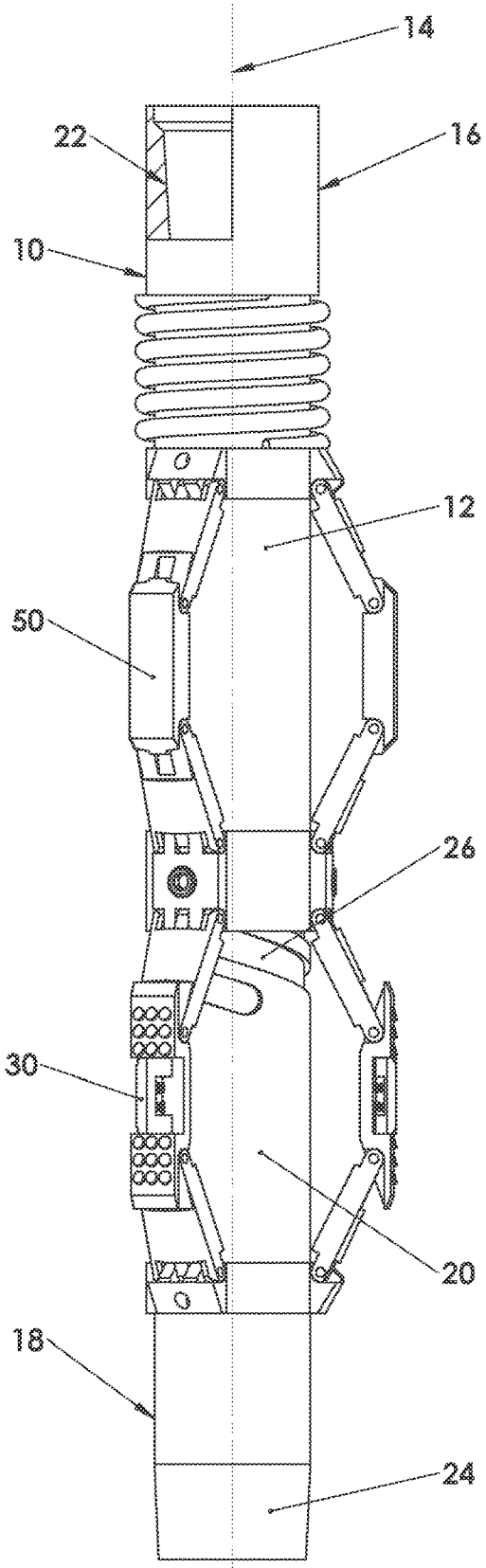
FIG. 1 is a perspective view of a high expansion anti-rotation anchor catcher

A high expansion anti-rotation anchor catcher generally identified by reference numeral 10, will now be described with reference to FIG. 1 through FIG. 6.

Structure and Relationship of Parts:

Referring to FIG. 1, high expansion anti-rotation anchor catcher 10 includes a tubular body 12 having an axis 14 (indicated in broken lines), a first end 16, a second end 18, and an exterior surface 20. A first coupling 22 is positioned at first end 16 of tubular body 12. A second coupling 24 is positioned at second end 18 of tubular body 12. A helical track 26 is positioned on exterior surface 20 of tubular body 12. Positioned around tubular body 12 is an expandable gripper cage, generally indicated by reference numeral 30, which will hereinafter be further described. Also positioned around tubular body 12 is an expandable centralizer cage, generally indicated by reference numeral 50, which will hereinafter be further described.

Figure 2:
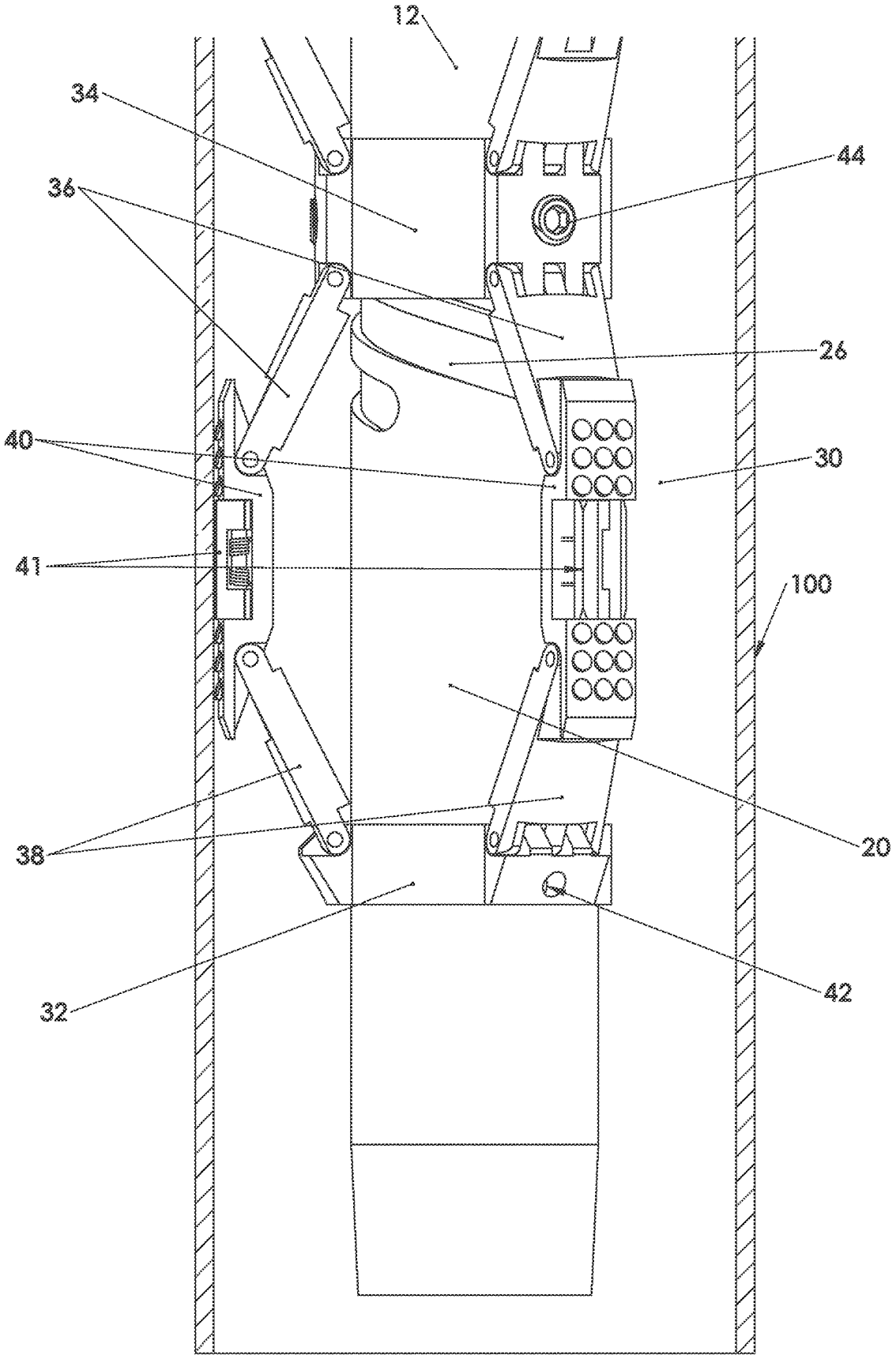
FIG. 2 is a detailed side elevation view of the expandable gripper cage of the high expansion anti-rotation anchor catcher of FIG. 1.

Referring to FIG. 2, expandable gripper cage 30 consists of an axially fixed hub 32 mounted for rotation about tubular body 12 and an axially movable hub 34 mounted for rotation about tubular body 12. Pairs of pivoting linkages 36 and 38 which support outwardly oriented grippers 40 extend between axially fixed hub 32 and axially movable hub 34. Axially fixed hub 32 has a track follower 42, in the form of set screws that engage a circular track (not shown) on exterior surface 20 of tubular body 12. (Set screws have been used for convenience of assembly, it will be understood that track follower 42 can be pins, protrusions or take other forms as long as they function to follow the track) This engagement facilitates rotation of axially fixed hub. Axially movable hub 34 has a track follower 44, in the form of set screws, which engages helical track 26 on exterior surface 20 of tubular body 12. (Set screws have been used for convenience of assembly, it will be understood that track follower 44 can be pins, protrusions or take other forms as long as they function to follow the track)

As will hereafter be further described, rotation of tubular body 12 in a first rotational direction causes the track follower 44 to move along helical track 26 toward axially fixed hub 32. This movement places expandable gripper cage 30 in compression and causes pivoting linkages 36 and 38 with grippers 40 to pivot outwardly away from tubular body 12. Rotation of tubular body 12 in a second rotational direction causes the track follower 44 to move along helical track 26 away from axially fixed hub 32, thereby placing expandable gripper cage 30 in tension and causing pivoting linkages 36 and 38 and gripper 40 to pivot inwardly toward tubular body 12.

Figure 4:
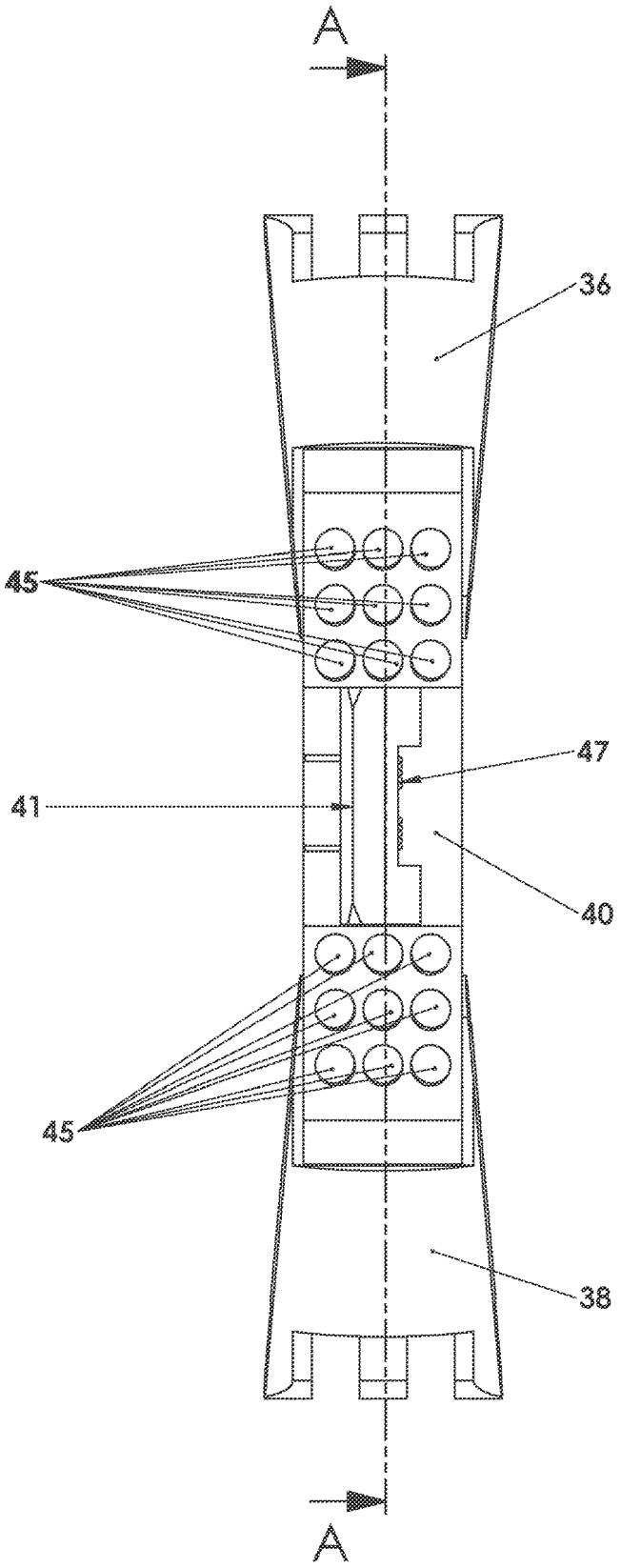
FIG. 4 is a side elevation view of pivotal links and gripper of the expandable gripper cage of the high expansion anti-rotation anchor catcher of FIG. 1.
Figure 5:
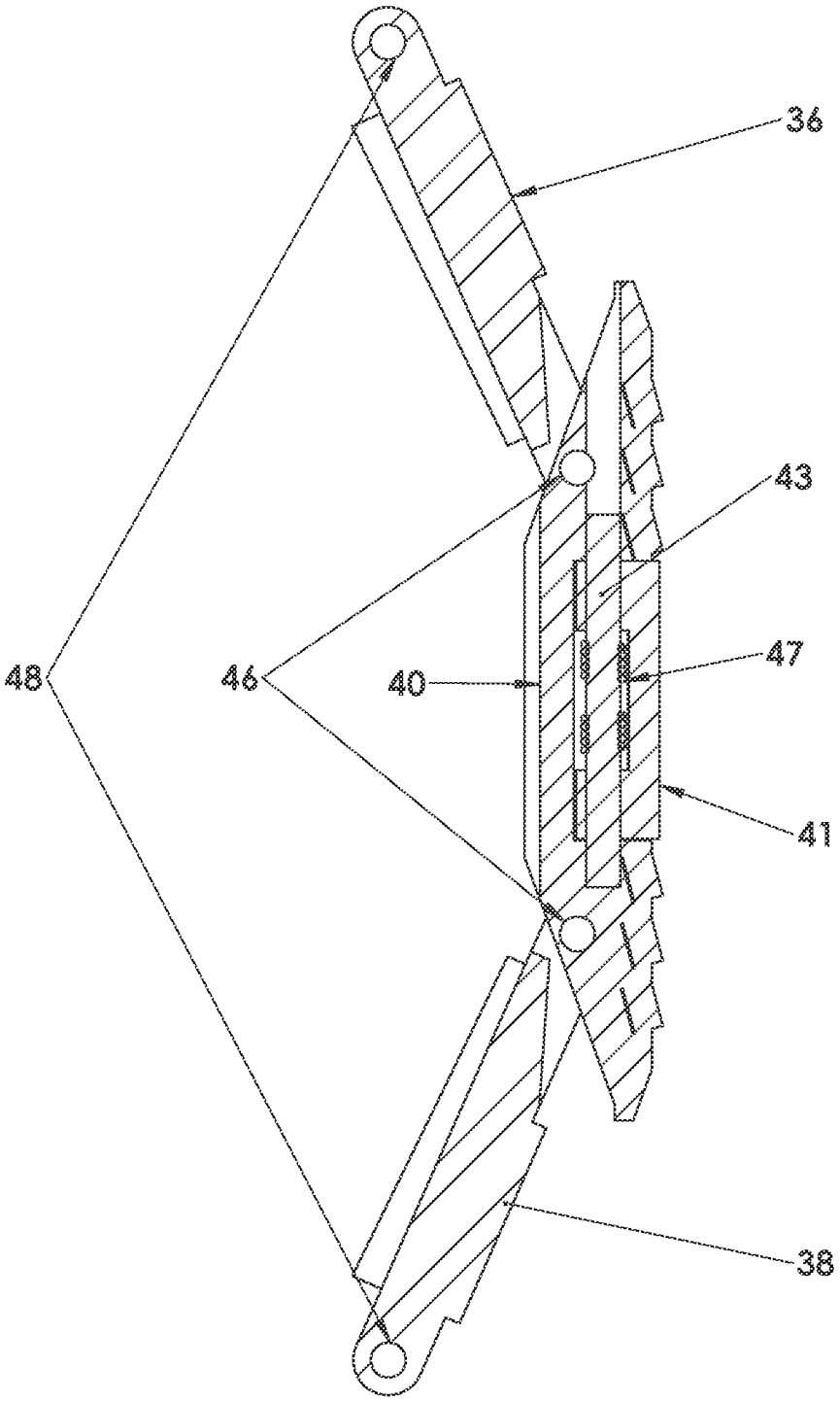
FIG. 5, is a section view of the pivotal links and gripper, taken along section lines A-A of FIG. 4.

Referring to FIG. 4, pivoting linkages 36 and 38, with associated gripper 40, are illustrated. Gripper 40 has on its surface carbide buttons 45. Referring to FIG. 5, pivot pins 46 pivotally connect gripper 40 with pivoting linkages 36 and 38. Pivot pins 48 connect pivoting linkages 36 and 38, with axially fixed hub 32 and axially movable hub 34, respectively. Gripper 40 has a tooth 41. Tooth 41 is pivotally mounted on a support pin 43 and is biased outwardly by a torsion spring 47. As will hereinafter be further described, tooth 41 is serves to prevent gripper 40 from becoming dislodged by rotation as a result of torque imparted by the PC pump. Tooth 41 is sometimes referred to in the industry as a "door", because tooth 41 pivots and swings outwardly in the manner similar to or reminiscent of a door.

Figure 3:
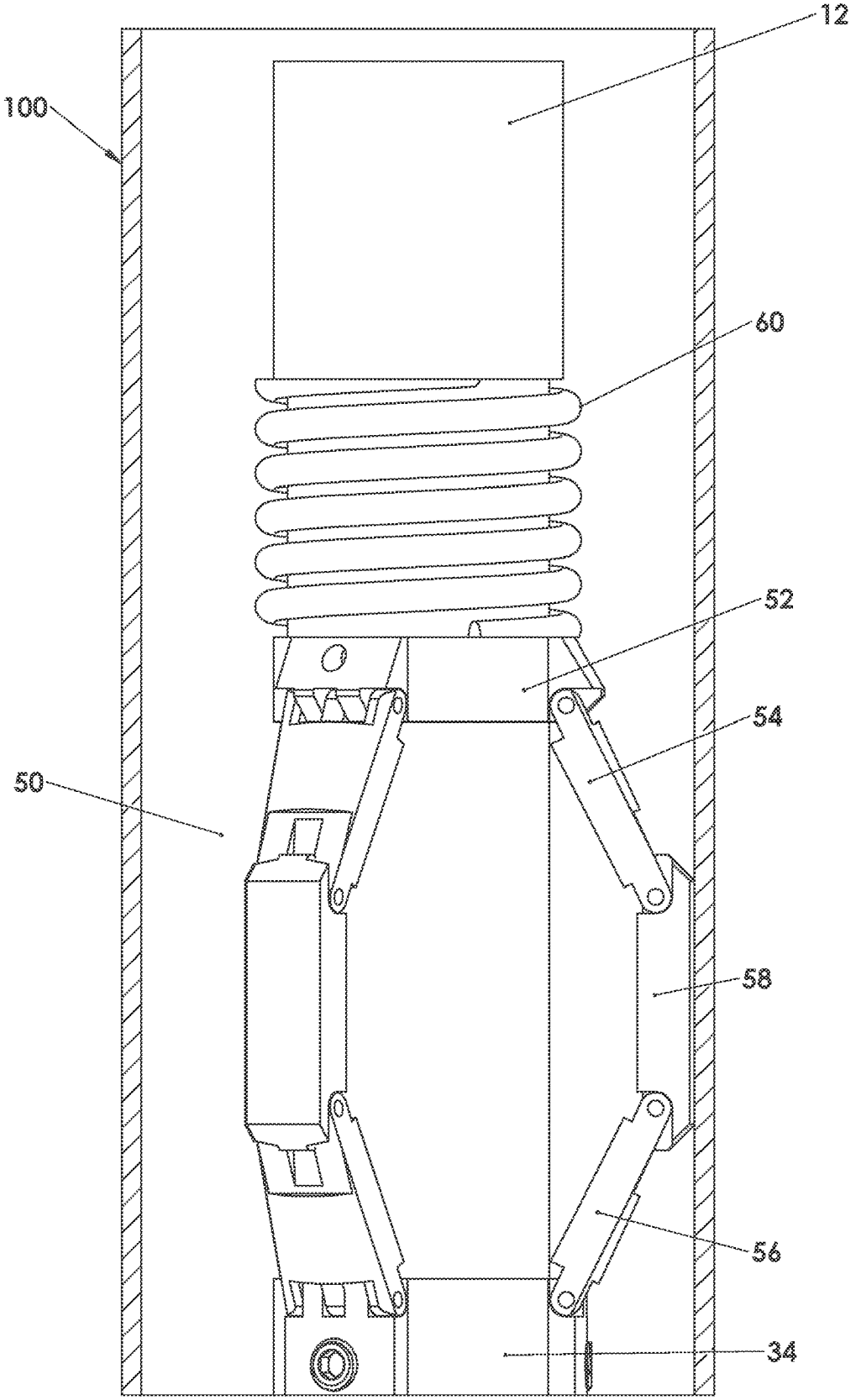
FIG. 3 is a detailed side elevation view of the expandable centralizer cage of the high expansion anti-rotation anchor catcher of FIG. 1.

Referring to FIG. 3, expandable centralizer cage 50 has an axially slidable hub 52 that slides axially along exterior surface 20 of tubular body 12 toward the axially movable hub 34 of expandable gripper cage 30. Pivoting linkages 54 and 56 which support centralizer blocks 58 extend between axially slidable hub 50 and the axially movable hub 34 of expandable gripper cage 30. A spring 60 is provided which acts against a shoulder 62 on exterior surface 20 of tubular housing 12 to exert a force upon axially slidable hub 50 urging axially slidable hub 50 along exterior 20 of the tubular body 12 toward axially slidable hub 34. As will hereinafter be further described, this movement places expandable centralizer cage 50 in compression and causes pivoting linkages 54 and 56 and centralizer block 58 to pivot outwardly away from tubular body 12. Spring 60 has been illustrated as a coil spring. It will be understood that a leaf spring or other form of spring could be used.

Operation:

Referring to FIG. 1, first coupling 22 and second coupling 24 are used to secure high expansion anti-rotation anchor catcher 10 to a tubing string being run into a pipe of an oil producing well. As previously noted, anti-rotation anchor 10 may be positioned either above or below a PC pump. During insertion, expandable gripper cage 30 is not deployed and is at rest with pivoting linkages 36 and 38 together with grippers 40 positioned as close as possible to tubular body 12. However, expandable centralizer cage 50 maintains anti-rotation anchor 10 in a central position, to avoid problems during insertion. Referring to FIG. 3, spring 60 acts against shoulder 62 on exterior surface 20 of tubular housing 12 to exert a force upon axially slidable hub 50 urging axially slidable hub 50 along exterior 20 of the tubular body 12 toward axially slidable hub 34. This movement places expandable centralizer cage 50 in compression and causes pivoting linkages 54 and 56 and centralizer blocks 58 to pivot outwardly away from tubular body 12. Referring to FIG. 3, centralizer blocks 58 on all sides of tubular body 12 contact pipe 100 of the oil producing well.

Figure 6:
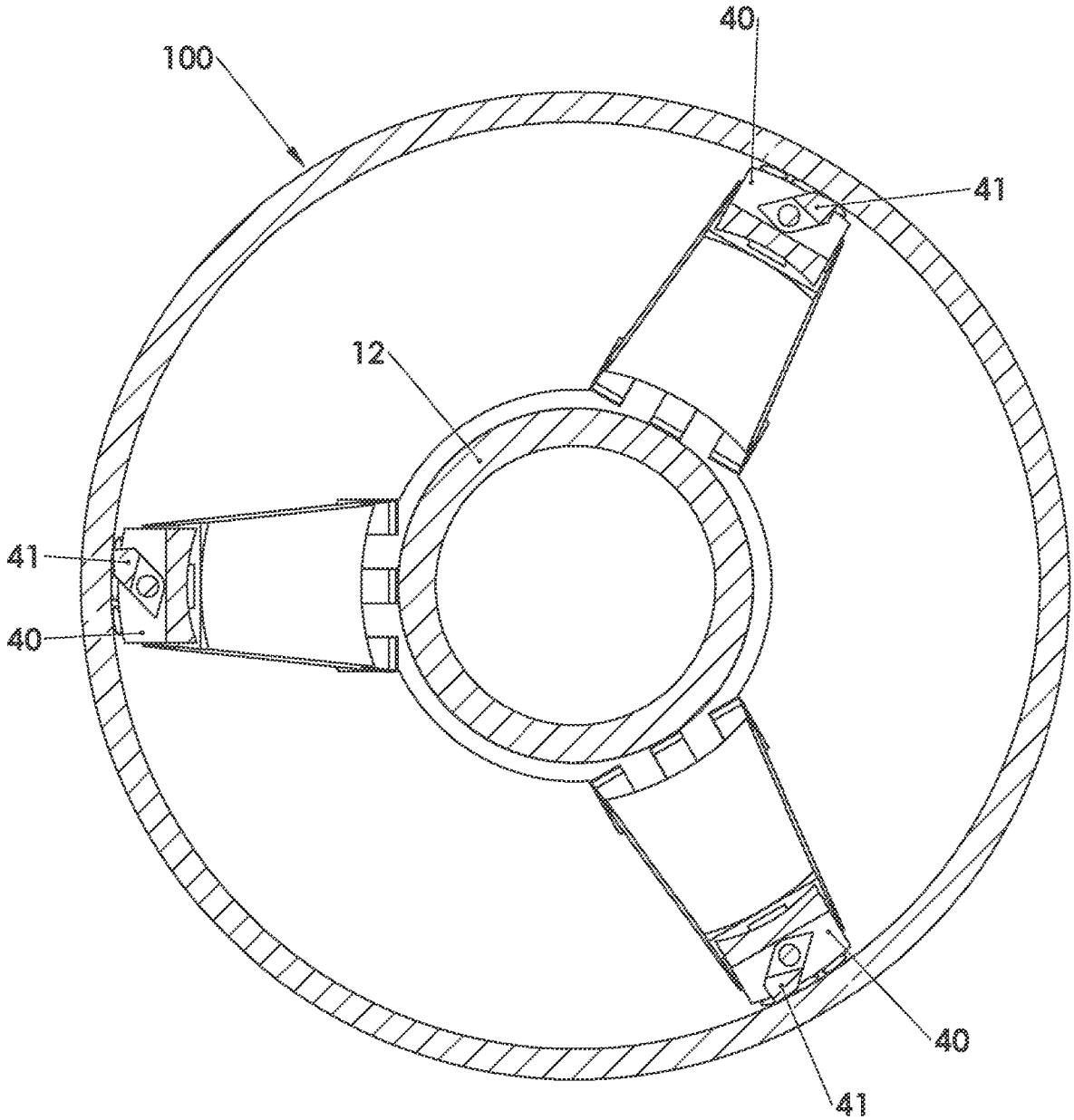
FIG. 6 is a section view of the high expansion anti-rotation anchor catcher positioned in a pipe of a producing oil well.

Once the PC pump has been inserted down the well at the end of the tubing string to a desired pumping depth, expandable gripper cage 30 is activated. As previously described, that activation involves rotation of tubular body 12 in a first rotational direction. This is accomplished by rotating the entire tubing string. As noted above, at the time of activation of expandable gripper cage 30, expandable centralizer cage 50 has already been deployed and centralizer blocks 58 on all sides of tubular body 12 are in contact with pipe 100 of the oil producing well. This results in expandable gripper cage 30 remaining in a stationary position while tubular body 12 rotates. Referring to FIG. 2, rotation in a first direction the track follower 44 on axially movable hub 34 to move along helical track 26 toward axially fixed hub 32. This movement places expandable gripper cage 30 in compression and causes pivoting linkages 36 and 38 with grippers 40 to pivot outwardly away from tubular body 12 to engage pipe 100, as shown in FIG. 6. Rotational force created by the PC pump during operation further rotates tubular body 12 results in the track follower 44 on axially movable hub 34 moving a little further along helical track 26 toward axially fixed hub 32 and causes grippers 40 to engage more forcefully. Tooth 41 biased outwardly by spring 47, engages pipe 100 to prevent rotational slippage of grippers 40. Once expandable gripper cage 30 is deployed with grippers 40 engaged, high expansion anti-rotation anchor catcher 10 performs an "anti-rotation" role by preventing rotation and also performs a "catcher" role by vertically arresting ("catching") the PC pump so it does not and cannot fall down the well.

From time to time, PC pump will need to be repositioned or brought up to surface for servicing. In order to release high expansion anti-rotation anchor catcher 10, it will be understood that rotation of tubular body 12 in a second rotational direction causes the track follower 44 on axially movable hub 34 to move along helical track 26 away from axially fixed hub 32, thereby placing expandable gripper cage 30 in tension and causing pivoting linkages 36 and 38 and gripper 40 to pivot inwardly toward tubular body 12.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A high expansion anti-rotation anchor catcher, comprising:

a tubular body having an axis, a first end, a second end, and an exterior surface;

at least one coupling positioned at the first end of the tubular body or the second end of the tubular body;

a helical track positioned on the exterior surface of the tubular body;

an expandable gripper cage having an axially fixed hub mounted for rotation about the tubular body and an axially movable hub mounted for rotation about the tubular body, pivoting linkages which support outwardly oriented grippers extend between the axially fixed hub and the axially movable hub;

the axially movable hub having a track follower that engages the helical track on the exterior surface of the tubular body, such that rotation of the tubular body in a first rotational direction causes the track follower to move along the helical track toward the axially fixed hub, thereby placing the expandable gripper cage in compression and causing the pivoting linkages and grippers to pivot outwardly away from the tubular body and such that such that rotation of the tubular body in a second rotational direction causes the track follower to move along the helical track away from the axially fixed hub, thereby placing the expandable gripper cage in tension and causing the pivoting linkages and grippers to pivot inwardly toward the tubular body.

2. The high expansion anti-rotation anchor catcher of claim 1, wherein an expandable centralizer cage is provided having an axially slidable hub that slides axially along the exterior of the tubular body toward a second hub, pivoting linkages which support centralizer blocks extend between the axially slidable hub and the second hub;

a spring is provided which acts against a shoulder on the exterior surface of the tubular housing to exert a force upon the axially slidable hub urging the axially slidable hub along the exterior of the tubular body toward the second hub, thereby placing the expandable centralizer cage in compression and causing the pivoting linkages and centralizer blocks to pivot outwardly away from the tubular body.

3. The high expansion anti-rotation anchor catcher of claim 2, wherein the axially movable hub of the expandable gripper cage serves as the second hub for the expandable centralizer cage.

4. The high expansion anti-rotation anchor catcher of claim 1, wherein the at least one coupling is comprised of a first coupling positioned at the first end of the tubular body and a second coupling positioned at the second end of the tubular body.

5. A high expansion anti-rotation anchor catcher, comprising:

a tubular body having an axis, a first end, a second end, and an exterior surface;

a first coupling positioned at the first end of the tubular body;

a second coupling positioned at the second end of the tubular body;

a helical track positioned on the exterior surface of the tubular body;

an expandable gripper cage having an axially fixed hub mounted for rotation about the tubular body and an axially movable hub mounted for rotation about the tubular body, pivoting linkages which support outwardly oriented grippers extend between the axially fixed hub and the axially movable hub;

the axially movable hub having a track follower that engages the helical track on the exterior surface of the tubular body, such that rotation of the tubular body in a first rotational direction causes the track follower to move along the helical track toward the axially fixed hub, thereby placing the expandable gripper cage in compression and causing the pivoting linkages and grippers to pivot outwardly away from the tubular body and such that such that rotation of the tubular body in a second rotational direction causes the track follower to move along the helical track away from the axially fixed hub, thereby placing the expandable gripper cage in tension and causing the pivoting linkages and grippers to pivot inwardly toward the tubular body;

an expandable centralizer cage having an axially slidable hub that slides axially along the exterior of the tubular body toward the axially movable hub of the expandable gripper cage, pivoting linkages which support centralizer blocks extend between the axially slidable hub and the expandable gripper cage;

a spring is provided which acts against a shoulder on the exterior surface of the tubular housing to exert a force upon the axially slidable hub urging the axially slidable hub along the exterior of the tubular body toward the axially slidable hub, thereby placing the expandable centralizer cage in compression and causing the pivoting linkages and centralizer blocks to pivot outwardly away from the tubular body.

* * * * *